United States Patent [19]

Rosenberger

[11] 4,225,450

[45] Sep. 30, 1980

[54] LUBRICANT COMPOSITIONS CONTAINING DITHIOCARBAMYL ANTIOXIDANTS

[75] Inventor: Siegfried Rosenberger, Riehen, Switzerland

[73] Assignee: Ciba-Geigy Corporation, Ardsley, N.Y.

[21] Appl. No.: 924,416

[22] Filed: Jul. 13, 1978

[30] Foreign Application Priority Data

Jul. 21, 1977 [CH] Switzerland ..... 9061/77

[51] Int. Cl.[3] ..... C10M 1/38

[52] U.S. Cl. ..... 252/47.5; 252/402; 252/404

[58] Field of Search ..... 252/47.5, 402, 404

[56] References Cited

U.S. PATENT DOCUMENTS

| | | | |
|---|---|---|---|
| 3,412,026 | 11/1968 | Booher | 252/47.5 X |
| 3,462,368 | 8/1969 | Wollensak et al. | 252/47.5 X |

FOREIGN PATENT DOCUMENTS

| | | |
|---|---|---|
| 1024651 | 3/1966 | United Kingdom . |
| 1049535 | 11/1966 | United Kingdom . |
| 1125900 | 9/1968 | United Kingdom . |

OTHER PUBLICATIONS

Denton, W. M. et al., "Screening of Compounds for Anti-Oxidant Activity in Motor Oil," Inst. of Pet. Review, Feb. 1966, pp. 46–54.

*Primary Examiner*—Andrew Metz
*Attorney, Agent, or Firm*—Luther A. R. Hall

[57] ABSTRACT

Esters of phenol-dithiocarbamic acids when added even in very small amounts to lubricants are effective as stabilizers against oxidation and corrosion, and also as extreme-pressure additives and anti-wear additives.

8 Claims, No Drawings

LUBRICANT COMPOSITIONS CONTAINING DITHIOCARBAMYL ANTIOXIDANTS

The present invention relates to lubricants stabilised with phenol-dithiocarbamides and to the use of phenol-dithiocarbamides for stabilising lubricants.

Various additives are generally added to mineral and synthetic lubricants in order to improve their characteristics in use. In particular, there is a need for additives which are intended to protect the devices to be lubricated from wear due to friction. The demands made upon such wear inhibitors are that they increase the load-bearing capacity of the lubricant and do not have a corrosive action on the metal parts to be protected.

Alkyl-substituted phenols and dithiocarbamides, for example the commercially available products 2,6-ditert.-butyl-4-methylphenol and S-benzyl-N,N-diethyl-dithiocarbamide, which are already widely used, are already generally known in the lubricants field as antioxidants. In U.S. Pat. No. 3,412,026, a lubricant composition is described which contains a small proportion of a mixture of an antimony N,N-dialkyldithiocarbamate and a dialkylhydroxybenzyl-N,N-diphenyl-dithiocarbamate and has good stability. British Patent Specification No. 1,024,651 describes metal salts of carbamides containing a 2,6-dialkylphenol which are to be employed as antioxidants and anti-wear additives in lubricants. However, it has been found that the action of these metal salt additives is impaired by the formation of residues.

Surprisingly, it has now been found that a very good antioxidant and anti-corrosive action can be achieved in lubricants by the addition of a small proportion of phenol dithiocarbamic acid esters. These compounds, which compared with the abovementioned additives for lubricants do not have a metal salt character, also give excellent results as "extreme-pressure" and "antiwear" additives.

Accordingly, the present invention relates to lubricants which contain, as stabiliser, a compound of the formula I

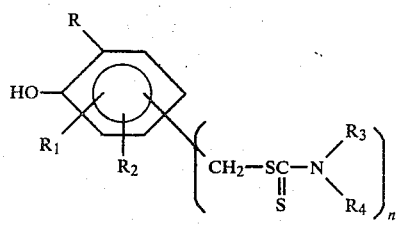

I in which R is $C_1$–$C_{12}$ alkyl, $C_5$–$C_7$ cycloalkyl, $C_6$–$C_{10}$ aryl which is unsubstituted or substituted by $C_1$–$C_6$ alkyl, or $C_7$–$C_{22}$ aralkyl, $R_1$ and $R_2$ each independently of one another are H or R an n can be the numbers 1 or 2, and, when n=1, $R_3$ is $C_1$–$C_{30}$ alkyl which is unsubstituted or substituted by —OH or —CN or is $C_2$–$C_{30}$ alkyl which is interrupted by —O—, and also is $C_2$–$C_{30}$ alkenyl, $C_6$–$C_{10}$ aryl which is unsubstituted or substituted by $C_1$–$C_6$ alkyl, or $C_7$–$C_{22}$ aralykyl, a group of the formula —$NR_1'R_2'$, in which $R_1'$ and $R_2'$ independently of one another are hydrogen or $C_1$–$C_{12}$ alkyl, or a group of the formula II

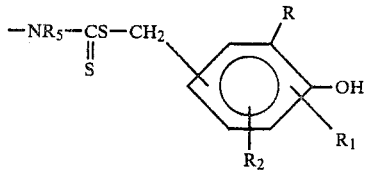

II in which R, $R_1$ and $R_2$ are as defined above and $R_5$ is hydrogen, or a group of the formula III

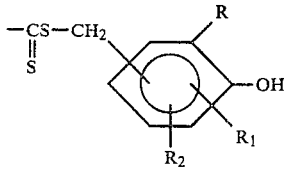

III in which R, $R_1$ and $R_2$ are as defined above, and $R_4$ is $C_1$–$C_{30}$ alkyl which is unsubstituted or substituted by —OH or —CN or is $C_2$–$C_{30}$ alkyl which is interrupted by —O—, and also is $C_2$–$C_{30}$ alkenyl, $C_6$–$C_{10}$ aryl which is unsubstituted or substituted by $C_1$–$C_6$ alkyl, or $C_7$–$C_{22}$ aralkyl or $R_5$, or $R_3$ and $R_4$ together form tetramethylene, pentamethylene or hexamethylene, which are unsubstituted or substituted by $C_1$–$C_6$ alkyl or interrupted by —O—, >N—$R_1$, in which $R_1$ is as defined above, or >N—$R_5$, in which $R_5$ is as defined above, and, when n=2, $R_3$ is $C_1$–$C_{30}$ alkyl which is unsubstituted or substituted by —OH or —CN or is $C_2$–$C_{30}$ alkyl which is interrupted by —O—, and also is $C_2$–$C_{30}$ alkenyl, $C_6$–$C_{10}$ aryl which is unsubstituted or substituted by $C_1$–$C_6$ alkyl, or $C_7$–$C_{22}$ aralkyl and $R_4$ is H or $R_3$, or $R_3$ and $R_4$ together form tetramethylene, pentamethylene or hexamethylene, which are unsubstituted or substituted by $C_1$–$C_6$ alkyl or interrupted by —O— or >N—$R_1$, in which $R_1$ is as defined above.

$C_{1-C12}$ alkyl R, $R_1'$ and $R_2'$ is branched or non-branched alkyl, such as methyl, ethyl, n-propyl, isopropyl, n-butyl, tert.-butyl, n-pentyl, α-methylpentyl, hexyl, 2,4-dimethylpentyl, octyl, 6-methylheptyl, 2-ethylhexyl, decyl or dodecyl. Preferred alkyl groups are those having 1–8 C atoms, but especially those having 1–4 C atoms.

$C_5$–$C_6$ cycloalkyl R is cyclopentyl, cycloheptyl and especially cyclohexyl.

$C_1$–$C_{30}$ alkyl $R_3$ and $R_4$ is linear or branched $C_1$–$C_{30}$ alkyl, especially $C_1$–$C_{18}$ alkyl, which is unsubstituted or monosubstituted or polysubstituted, but preferably only monosubstituted, by —OH or —CN. Examples are methyl, ethyl, propyl, isopropyl, butyl, tert.-butyl, n-pentyl, α-methylpentyl, hexyl, 2,4-dimethylpentyl, octyl, 6-methylheptyl, 2-ethyl-hexyl, decyl, dodecyl, octadecyl, octadecylethyl, eicosyl, docosyl, pentacosyl or triacontyl, all of which can be substituted, preferably monosubstituted, by —OH or —CN. Linear unsubstituted and uninterrupted $C_1$–$C_{18}$ alkyl is preferred.

$C_2$–$C_{30}$ alkyl, interrupted by —O—, $R_3$ and $R_4$ is, for example, methoxymethyl, ethoxymethyl, 2-methoxyethyl, 2-ethoxyethyl, 2-n-butoxyethyl, 3-n-butoxyethyl, 2-n-octoxyethyl, 2-n-octadecycloxyethyl, 4-n-butoxyoctyl, 8-n-octoxybutyl or 12-n-dodecyloxyoctadecyl.

$C_2$–$C_{30}$ alkenyl $R_3$ and $R_4$ is branched or non-branched alkenyl with one or more double bonds. Linear $C_2$–$C_{20}$ alkenyl with one double bond is preferred, for example vinyl, allyl, butenyl, hexenyl, octenyl, decenyl, dodecenyl, hexadecenyl, octadecenyl or oleyl.

$C_6$–$C_{10}$ aryl, which is unsubstituted or substituted by $C_1$–$C_6$ alkyl, R, $R_3$ and $R_4$ is phenyl or naphthyl, which are unsubstituted or polysubstituted, but especially monosubstituted, by linear or branched $C_1$–$C_6$ alkyl, for example methylphenyl or methylnapthyl. These radicals are especially p-substituted phenyl or 1-naphthyl substituted in the 4-position, but preferably unsubstituted phenyl or 1-naphthyl.

$C_7$–$C_{22}$ aralkyl R, $R_3$ and $R_4$ is phenalkyl or naphthalkyl, in which the alkyl part in each case consists of branched or non-branched $C_1$–$C_{12}$, *but especially* $C_1$–$C_4$, alkyl. Preferred aralkyl radicals are α-phenethyl and especially benzyl.

If $R_3$ and $R_4$ together form tetramethylene, hexamethylene or especially pentamethylene, which are unsubstituted or substituted by $C_1$–$C_6$ alkyl or interrupted by —O— or —N—, they form, together with the nitrogen atom which links them, in particular a piperdine ring, a morpholine ring or a piperazine ring.

When n=1, the dithiocarbamide group is in the o-position or especially in the m-position or p-position, but preferably in the p-position, relative to the hydroxyl group on the phenol ring.

When n=2, the dithiocarbamide groups are bonded to the phenol in the 2,4-position or preferably in the 3,5-position.

Preferred lubricants are those which contain, as stabiliser, a compound of the formula I in which R and $R_1$ are $C_1$–$C_8$ alkyl, phenyl or benzyl and $R_2$ is hydrogen or $C_1$–$C_8$ alkyl, $R_3$ and $R_4$ are identical and are $C_1$–$C_{18}$ alkyl or $C_2$–$C_{20}$ alkenyl and n can be the numbers 1 or 2, and when n=1 the dithiocarbamide group is in the m- or p-position relative to the hydroxyl group of the phenol and when n=2 the two dithiocarbamide groups are bonded to the phenol in the 3,5-position.

Lubricants of very particular interest are those which contain, as stabiliser, a compound of the formula IV

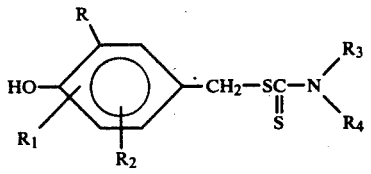

IV in which R and $R_1$ are $C_1$–$C_4$ alkyl, $R_2$ is hydrogen or methyl and $R_3$ and $R_4$ are identical and are linear $C_1$–$C_{18}$ alkyl.

Preferred lubricants are those which contain, as stabiliser, a compound of the formula

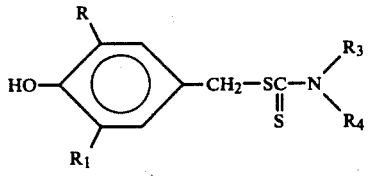

in which R and $R_1$ are $C_1$–$C_4$ alkyl and $R_3$ and $R_4$ are identical and are $C_2$–$C_{12}$ alkyl.

Further preferred lubricants are those which contain, as stabiliser, a compound of the formula

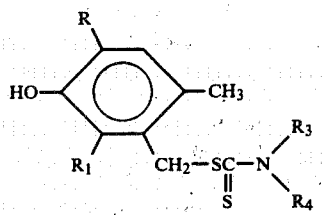

in which R and $R_1$ are $C_1$–$C_4$ alkyl and $R_3$ and $R_4$ are identical and are linear $C_2$–$C_{12}$ alkyl.

The m-hydroxybenzyl-dithiocarbamides to be used according to the invention can be obtained by generally known methods, by, for example, reacting mono- or dichloromethylphenols of the formulae

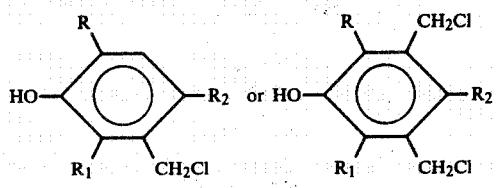

with the equivalent amounts of corresponding Na dithiocarbamates of the formula

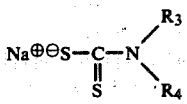

in an inert solvent, such as acetonitrile, toluene, ether or chloroform, with the elimination of NaCl.

The ortho- and especially the para-hydroxybenzyldithiocarbamides are obtainable by a procedure analogous to that cited above for the meta-derivatives, but they are preferably prepared by known methods, by reaction of molar amounts of a corresponding substituted phenol of the formula

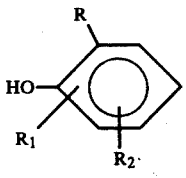

with formaldehyde, carbon disulphide and an amine of the formula

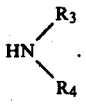

The compounds of the formula I are substances which are known per se and which have already found application as stabilisers for rubber (British Patent Specification No. 1,049,535) and for copolymer resins (British Patent specification No. 1,125,900).

Even in very small amounts, the compounds of the formula I are effective as stabilisers against the effects of oxidation and corrosion and also as "extreme-pressure" additives and "antiwear" additives in lubricants. Thus, mineral and synthetic lubricating oils, and also mixtures thereof, which contain 0.001 to 5% by weight and preferably 0.02 to 3% by weight, based on the lubricant, of a compound of the formula I exhibit excellent lubricant properties which become evident from the markedly reduced signs of wear of the parts under friction, which are to be lubricated.

The lubricants are commonly known to those skilled in the art and are described, for example, in "Schmiermittel-Taschenbuch" ("Lubricants Handbook") (Huthig Verlag, Heidelberg, 1974). Mineral oils are particularly suitable.

The lubricating oil formulation can additionally contain yet further additives, which are added in order to improve certain performance properties, such as antioxidants, metal passivators, rust inhibitors, viscosity index improvers, pour-point depressors, dispersants/surfactants and other wear-resisting additives.

Examples of antioxidants are:

(a) Alkylated and non-alkylated aromatic amines and mixtures thereof, for example: dioctyldiphenylamine, (2,2,3,3-tetramethyl-butyl)-phenyl-α- and -β-naphthylamines, phenothiazine, dioctylphenothiazine, phenyl-α-naphthylamine and N,N'-di-sec.-butyl-p-phenylenediamine.

(b) Sterically hindered phenols, for example: 2,6ditert.-butyl-p-cresol, 4,4'-bis-(2,6-diisopropyl-phenol), 2,4,6-triisopropylphenol, 2,2'-thio-bis-(4-methyl-6-tert.-butyl-phenol) and 4,4'-methylene-bis-(2,6-di-tert.-butylphenol).

(c) Alkyl phosphites, aryl phosphites or alkaryl phosphites, for example: trinonyl phosphite, triphenyl phosphite and diphenyl decyl phosphite.

(d) Esters of thiodipropionic acid or thiodiacetic acid, for example: dilauryl thiodipropionate or dioctyl thiodiacetate.

(e) Salts of carbamic and dithiophosphoric acids, for example: antimony diamyldithiocarbamate and zinc diamyldithiophosphate.

(f) A combination of two or more of the above antioxidants, for example: an alkylated amine and a sterically hindered phenol.

Examples of metal passivators are:

(a) For copper, for example: benzotriazole, tetrahydrobenzotriazole 2-mercaptobenzotriazole, 2,5-dimercaptothiadiazole, salicylidene-propylenediamine and salts of salicylaminoguanidine.

(b) For lead, for example: sebacic acid derivatives, quinizarine and propyl gallate.

(c) A combination of two or more of the above additives.

Examples of rust inhibitors are:

(a) Organic acids and their esters, metal salts and anhydrides, for example: N-oleoyl-sarcosine, sorbitane monooleate, lead naphthenate and dodecenylsuccinic anhydride.

(b) Nitrogen-containing compounds, for example: I. Primary, secondary or tertiary aliphatic or cycloaliphatic amines and amine salts of organic and inorganic acids, for example oil-soluble alkylammonium carboxylates. II. Heterocyclic compounds, for example: substituted imidazolines and oxazolines.

(c) Phosphorus-containing compounds, for example: amine salts of phosphoric acid partial esters.

(d) Sulphur-containing compounds, for example: barium dinonylnaphthalene-sulphonates and calcium petroleum-sulphonates.

(e) Combinations of two or more of the above additives.

Examples of viscosity index improvers are:

Polymethacrylates, vinylpyrrolidone/methacrylate copolymers, polybutenes, olefin copolymers and styrene/acrylate copolymers.

Examples of pour-point depressors are:

Polymethacrylates and alkylated naphthalene derivatives.

Examples of dispersants/surfactants are:

Polybutenylsuccinimides, polybutenylphosphonic acid derivatives and basic magnesium, calcium and barium sulphonates and phenolates.

Examples of other wear-resisting additives are:

Compounds containing sulphur and/or phosphorus and/or halogen, such as sulphurised vegetable oils, zinc dialkyl-dithiophosphates, tritolyl phosphate, chlorinated paraffins, alkyl disulphides and aryl disulphides.

The preparation of the compounds to be used as stabilisers in the lubricants according to the invention and also the use and action of the lubricant compositions according to the invention are described in more detail in the following examples.

EXAMPLE 1

S-(3-Hydroxy-4-tert.-butyl-2,6-dimethylbenzyl)-N,N-di-n-octyldithiocarbamide 34 g of sodium N,N-di-n-octyldithiocarbamate are dissolved in 300 ml of acetonitrile and a solution of 22.7 g of 3-hydroxy-4-tert.-butyl-2,6-dimethyl-benzyl chloride (for the preparation see Makromolekulare Chemie, volume 9 (1952), pages 21/22) in 50 ml of toluene is added in the course of 30 minutes, at 10° C., with stirring. The reaction mixture is then stirred for about 15 hours at 20°–25° C., during which time a precipitation of sodium chloride can be observed.

The mixture is then poured into about 1 liter of ice-water and, after adding a further 100 ml of toluene, the toluene phase is separated off, extracted by shaking with water, dried over calcium chloride and evaporated in vacuo. S-(3-Hydroxy-4-tert.-butyl-2,6-dimethylbenzyl)-N,N-di-n-octyl-dithiocarbamide remains in the form of a brownish viscous oil and is already sufficiently pure for use as a stabiliser, and according to elemental analysis and chromatography is substantially a single compound.

Replacing sodium N,N-di-n-octyldithiocarbamate in the above example by one of the homologous sodium salts

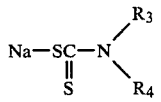

and following an analogous procedure yields the corresponding dithiocarbamides of the particular amines

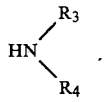

in the following table.

Table

| Example | $R_3$ | $R_4$ | Melting point |
|---|---|---|---|
| 2 | $-C_2H_5$ | $-C_2H_5$ | 168° C. |

Table-continued

| Example | $R_3$ | $R_4$ | Melting point |
|---|---|---|---|
| 3 | $-C_4H_9(n)$ | $-C_4H_9(n)$ | viscous oil |
| 4 | $-C_{12}H_{25}(n)$ | $-C_{12}H_{25}(n)$ | viscous oil |
| 5 | 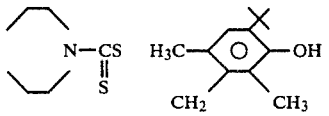 | | 255° C. |
| 6 | $-C_{12}H_{25}(n)$ | H | 101° C. |

Further p- and o-hydroxybenzyldithiocarbamides to be used according to the invention are listed in the following table. They are obtained by known methods, preferably by reacting corresponding phenols (column 2 in the table) with formaldehyde, carbon disulphide and the corresponding secondary amine (column 3 in the table) (for example according to U.S. Pat. No. 2,575,174).

| Example | Phenol | Amine | End Product | Melting point |
|---|---|---|---|---|
| 7 | 2,6-di-tert.-butyl-phenol | di-n-octylamine | S-(3,5-di-tert.-butyl-4-hydroxy-benzyl)-N,N-di-n-octyl-dithiocarbamide | viscous oil |
| 8 | 2,6-di-tert.-butyl-phenol | di-n-butylamine | S-(3,5-di-tert.-butyl-4-hydroxy-benzyl)-N,N-di-n-butyl-dithiocarbamide | 74° C. |
| 9 | 2-tert.-butyl-4-n-nonyl-phenol | diethylamine | S-(3-tert.-butyl-5-n-nonyl-2-hydroxybenzyl)-N,N-diethyl-dithiocarb-amide | viscous oil |
| 10 | 2,4-di-tert.-butyl-phenol | diethylamine | S-(3,5-di-tert.-butyl-2-hydroxybenzyl)-N,N-di-ethyl-dithiocarbamide | 124°-25° C. |
| 11 | 2,6-di-tert.-butyl-phenol | diethylamine | S-(3,5-di-tert.-butyl-4-hydroxybenzyl)-N,N-di-ethyl-dithiocarbamide | 109° C. |

Further bifunctional dithiocarbamides to be used according to the invention are illustrated in the following examples.

EXAMPLE 12

3,5-Di-(N,N-diethyl-thiocarbamoyl-mercaptomethyl)-2,4,6-trimethylphenol

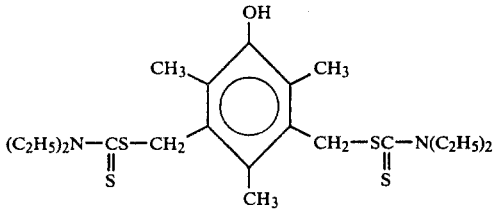

17.1 g of sodium N,N-diethyl-dithiocarbamate are suspended in 160 ml of acetonitrile and a solution of 11.7 g of 3,5-dichloromethyl-2,4,6-trimethylphenol (for the preparation see Makromolekulare Cehmie, volume 9, (1952), page 13) in 100 ml of chloroform is added in the course of 30 minutes, at 10° C., with stirring.

The batch is then stirred for 10 hours at room temperature and the sodium chloride which has precipitated is dissolved by adding 50 ml of water. The organic phase is separated off, washed with water and dried over calcium chloride. The solid evaporation residue is recrystallised from acetonitrile. The 3,5-di-(N,N-diethyl-thiocarbamoylmercaptomethyl)-2,4,6-trimethylphenol thus obtained melts at 146° C.

EXAMPLE 13

3,5-Di-(N,N-di-n-octyl-thiocarbamoylmercaptomethyl)-2,4,6-trimethylphenol

Replacing the sodium N,N-diethyl-dithicarbamate in Example 7 by the corresponding N,N-di-n-octyl compound and following an otherwise identical procedure yields 3,5-di-(N,N-di-n-octyl-thiocarbamoylmercaptomethyl)-2,4,6-trimethylphenol with a melting point of about 60° C.

EXAMPLE 14

Oil oxidation test standard version according to ASTM D 2272 (Rotary Bomb Oxidation Test)

An oil sample of 50 ml of SHELL "rotary vacuum oil" (viscosity 11 cSt./100° C.)* is oxidised in an oxygen atmosphere with the addition of 0.25 g of stabiliser in a glass vessel together with 5 ml of distilled water and a bright polished Cu spiral which has been washed with petroleum ether and acts as a catalyst.

*In a second test series the base oil used was Shell Vitrea 41.

The glass vessel is in a stainless steel bomb fitted with a manometer. The bomb rotates axially at 100 revolutions/minute at an angle of 30° to the horizontal, in an oil bath at 150° C. The oxygen pressure is initially, prior to heating, about 6 atmospheres (90 psi), rises to barely 14 atmospheres (200 psi) at 150° C. and remains constant until oxidation starts. The test is ended when the pressure has fallen by 1.7 atmospheres (25 psi). The time in minutes is recorded.

The following stabilisers were included in the test series to compare the action:

| Stabiliser | Minutes taken for the pressure to fall by 25 psi | |
|---|---|---|
| | Rot. Vac. P. Oil | Vitrea 41 |
| without | 46 | 16 |
| Example 1 | 514 | |
| Example 3 | 340 | |
| Example 7 | 457 | 332 |
| Example 8 | 298; 335 | |

EXAMPLE 15

Oil oxidation test according to IP 280, "CIGRE"

Modified version with soluble Cu and Fe catalyst

Conditions: pass in oxygen for 4 hours at 150° C. (4 liters of $O_2$/hour).

Determination of the acid number after the end of the test; table value: mg of KOH consumed per g of test oil.

Stabiliser concentration: 0.5%.

Test oil: Shell rotary vacuum oil (viscosity 11 cSt./100° C.).

Table

| Stabilizer | mg of KOH/g |
|---|---|
| without | 3.6 |
| Example 1 | 0.29 |
| Example 3 | 0.25 |
| Example 7 | 0.35 |
| Example 8 | 0.43 |

EXAMPLE 16

Test to determine the action as oxidation-resistant and corrosion-resistant agents in gas turbine oil by the FTMS 5308. C method Conditions: pass in air for 3 days at 174° C.

Stabiliser concentration: 0.5%.

Test oil: Shell rotary vacuum oil (viscosity 11 cSt./100° C.).

Table values:

ΔV: rise in viscosity at 37.5° C. (100° F.) in %.

ΔNN: rise in the neutralisation number in mg of KOH/g of test oil.

Table

| Stabilizer | ΔV | ΔNN |
|---|---|---|
| without | 59.2 | 4.1 |
| Example 1 | 10 | 2.7 |
| Example 3 | 31 | 3.1 |
| Example 7 | 16 | 2.1 |
| Example 8 | 6 | 3.6 |

EXAMPLE 17

The following values were determined using the Shell four-ball apparatus: (tentative method IP 239/69, Extreme pressure and wear lubricant test for oils and greases, four-ball machine).

(1) I.S.L.: Initial Seizure Load: that is the load under which the oil film collapses within a load period of 10 seconds.

(2) W.L.=Weld Load: that is the load under which the four balls weld together within 10 seconds.

(3) W.S.D.=Wear Scar Diameter in mm: that is the average wear diameter after subjection to a load of 70 kg or 40 kg for 1 hour.

Catenex 41 (Shell tradename) was used as the base oil.

Stabiliser concentration: 1% by weight.

Table

| Stabiliser | ISL (kg) | WL (kg) | WSD (mm) |
|---|---|---|---|
| without | about 60 | about 160 | about 2.4 |
| Example 6 | — | 215 | 1.7 |
| Example 8 | 100 | 210 | 1.67 |
| Example 9 | 95 | 200 | 1.1 |
| Example 10 | 90 | 215 | 1.0 |
| Example 11 | 80 | 230 | 1.0 |

What is claimed is:

1. A lubricant comprising a major proportion of an oil of lubricating viscosity and from 0.001 to 5% by weight of a stabilizer of the formula I

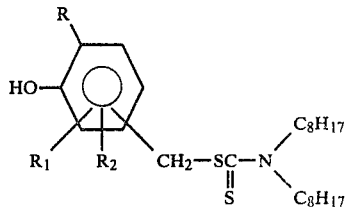

wherein

R and $R_1$ is $C_1$–$C_8$ alkyl, phenyl or benzyl, $R_2$ is hydrogen or $C_1$–$C_8$ alkyl and the dithiocarbamic group is in the m- or p-position relative to the hydroxyl group of the phenol.

2. A lubricant according to claim 1, which contains, as stabiliser, a compound of the formula IV

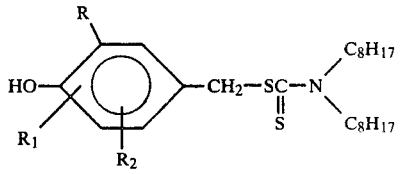

IV in which R and $R_1$ are $C_1$–$C_4$ alkyl, $R_2$ is hydrogen or methyl.

3. A lubricant according to claim 1, which contains, as stabiliser, a compound of the formula

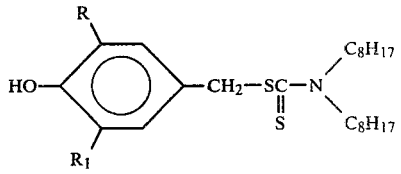

in which R and $R_1$ are $C_1$–$C_4$ alkyl.

4. A lubricant according to claim 1, which contains, as stabiliser, a compound of the formula

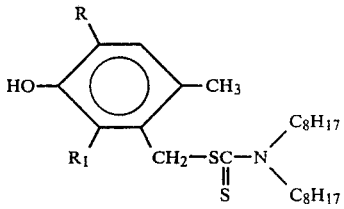

in which R and $R_1$ are $C_1$–$C_4$ alkyl.

5. A lubricant according to claim 1, which contains, as stabiliser, S-(3-hydroxy-4-tert.-butyl-2,6-dimethylbenzyl)-N,N-di-n-octyl-dithiocarbamide.

6. A lubricant according to caim 1, which contains, as stabiliser, S-(3,5-di-tert.-butyl-4-hydroxybenzyl)-N,N-di-n-octyl-dithiocarbamide.

7. A method of stabilizing a lubricant, said lubricant comprising a major proportion of an oil of lubricating viscosity which comprises incorporating into the lubricant from 0.001 to 5% of a compound of the formula

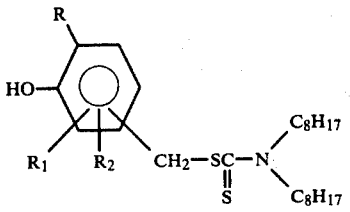
wherein
R and $R_1$ is $C_1$–$C_8$ alkyl, phenyl or benzyl, $R_2$ is hydrogen or $C_1$–$C_8$ alkyl and the dithiocarbamic group is in the m- or p-position relative to the hydroxyl group of the phenol.
8. The method according to claim 7 wherein said lubricant is mineral oil.
* * * * *